United States Patent [19]

O'Neal

[11] Patent Number: 4,862,702

[45] Date of Patent: Sep. 5, 1989

[54] HEAD PRESSURE CONTROL SYSTEM FOR REFRIGERATION UNIT

[76] Inventor: Andrew W. O'Neal, 18517- 8th Ave. N.E., Seattle, Wash. 98155

[21] Appl. No.: 164,976

[22] Filed: Mar. 7, 1988

Related U.S. Application Data

[63] Continuation-in-part of Ser. No. 20,376, Mar. 2, 1987, Pat. No. 4,735,059.

[51] Int. Cl.[4] ..... F25B 41/00

[52] U.S. Cl. ..... 62/196.4; 62/509; 62/DIG. 17

[58] Field of Search ..... 62/509, 196.4, 196.1, 62/117, 125, 126, 129, 174, DIG. 17

[56] References Cited

U.S. PATENT DOCUMENTS

| | | | |
|---|---|---|---|
| Re. 19,700 | 9/1935 | Williams | 62/126 X |
| 3,248,895 | 5/1966 | Mauer | 62/196.4 X |
| 3,844,131 | 10/1974 | Gianni et al. | 62/196.1 X |
| 4,167,102 | 9/1979 | Willitts | 62/152 |
| 4,328,682 | 5/1982 | Vana | 62/196.4 |
| 4,457,138 | 7/1984 | Bowman | 62/196.1 |
| 4,566,288 | 1/1986 | O'Neal | 62/196.1 |

*Primary Examiner*—Harry B. Tanner

*Attorney, Agent, or Firm*—Garrison & Stratton

[57] ABSTRACT

An improved refrigeration system that has an air cooled condenser exposed to outdoor ambient conditions and which automatically maintains sufficient head pressure during cooler weather for adequate liquid flow to the expansion valve of the evaporator by backflooding the condenser. Sub-cooling of the liquid in the condenser results from the backflooding and this sub-cooled liquid flows into the liquid line to the expansion valve. The liquid line out of the receiver joins the liquid line below the receiver so that the pressure in the receiver can be used to maintain the liquid level and the presence of liquid at the condenser. Means is provided to control the refrigerant pressure in the receiver in response to liquid level in the outlet line from the condenser.

8 Claims, 4 Drawing Sheets

HEAD PRESSURE CONTROL SYSTEM FOR REFRIGERATION UNIT

RELATED APPLICATION

This application is a continuation-in-part of my copending U.S. patent application, Ser. No. 020,376, filed Mar. 2, 1987, now issued as U.S. Pat. No. 4,735,059.

BACKGROUND OF THE INVENTION

In a conventional refrigeration system, the capacity of an air cooled condenser is proportional to the temperature difference between the condensing temperature of the refrigerant and the ambient air temperature entering the condenser. The condenser is usually designed to operate efficiently at a temperature difference which is suitable for summer conditions. In winter conditions, the capacity of the condenser increases substantially because of the reduction in the ambient air temperature which enters the condenser. When the capacity of the condenser increases, the system-head pressure and the liquid-line pressure decrease, the liquid refrigerant in the liquid supply line which feeds the expansion valve flashes to a gaseous state, and consequently the amount of liquid refrigerant which is available to the evaporator is reduced. Because of these problems, a head-pressure control mechanism is required in colder ambient conditions to elevate the head pressure, thereby, increasing the efficiency of the system.

Many methods of controlling the head-pressure have been used. One such method regulates the amount of the ambient air which passes through the condenser by either cycling the fans or by controlling the speed of the fan motors. Alternatively, dampers have been used to limit the airflow through the condenser. Backflooding of the liquid refrigerant into the condenser, which limits the condensing surface, also achieves head-pressure control. Many such control systems have been proposed or are in use, such as those systems described in: U.S. Pat. Nos. 2,934,911; 2,986,899; 2,954,681; 2,963,877; 3,905,202; 4,068,494; 4,373,348, and 4,457,138.

Backflood of the condenser results in the sub-cooling of the liquid refrigerant which is in the condenser. By sub-cooling the liquid refrigerant, there is less need to use some of the latent heat of evaporation to cool the liquid refrigerant from the condensing temperature to the temperature ion takes place. This increases the efficiency at which evaporation takes place. This increases the efficiency of the system. The value of the sub-cooled liquid is usually lost, however, because the sub-cooled liquid is mixed with the discharge gas at the head-pressure control valve prior to entering the receiver or it is mixed with the discharge gas being diverted to the receiver.

Some systems bypass the sub-cooled liquid around the receiver such as described in Pat. Nos. 3,905,202, 4,430,866, 4,457,138, and 4,522,037. These systems use a "surge" receiver whereby the condenser drain line makes a three way connection with the bottom of the receiver and the liquid line supplying the evaporators. In warmer weather these systems retain the problem of controlling the amount of uncondensed gas which passes to the expansion valve from the condenser. Dealing with this problem, a subcooler in the liquid supply line to the evaporators can be used to condense the flash gas but this requires additional compressor capacity.

Expansion valves are designed to operate with only liquid entering at their inlet ports. The entrance of uncondensed gas into the expansion valve reduces the efficiency of the expansion valve so that an inadequate supply of liquid refrigerant is sent to the evaporator, and the efficiency of the system is lowered.

Dealing with this problem, Taft et al., U.S. Pat. No. 3,905,202, Willitts, U.S. Pat. No. 4,430,866, and Ares et al., U.S. Pat. No. 4,522,037 suggest that an evaporative sub-cooler should be used in the liquid supply line which leads to the expansion valve to condense any flash gas that may occur. In effect, the evaporative sub-cooler can act as an additional condenser. Such systems require greater work from the compressor. Vana, U.S. Pat. No. 4,328,682 teaches that a solenoid valve, which is controlled by a sensing device that detects flashing in the liquid line, should be used to divert discharge gas to the top of the receiver. Bowman, U.S. Pat. No. 4,457,128 discloses a inlet pressure regulating valve that discharges into the bottom of the receiver which in warm weather conditions causes heating of liquid in the receiver. A temperature controlled solenoid valve that bypasses the receiver is also shown that connects up stream from the inlet pressure regulating valve which can interfere with backflooding of the condenser. My prior patent, O'Neal, U.S. Pat. No. 4,566,288, teaches that a liquid level sensor should be placed in a chamber at the outlet of the condenser to detect the passage of uncondensed gas and activate a solid state circuit to close a solenoid valve in the bypass line and prevent the flow of uncondensed gas to the liquid line. This design has worked very well, however, in some cases the cost of purchasing and installing the solid state circuitry is economically prohibitive. A simpler method of controlling the head pressure and preventing the flashing of gas into the expansion valve is described in my copending U.S. patent application No. 020,376, filed Mar. 2, 1987, now U.S. Pat. No. 4,735,059, issued Apr. 5, 1988, whereby the static pressure in a drop leg out of the receiver and a sub receiver prevents flash gas from entering the liquid line to the evaporators.

OBJECTIVES OF THE INVENTION

The principal object of the present invention is to provide an improved method and apparatus for controlling a minimum head pressure of a refrigeration system.

A further object is to reduce the cost and installation labor required to control the head pressure and to prevent the flashing of uncondensed gas into the expansion valve.

Another object is to provide an improved method and apparatus for increasing the efficiency of a refrigeration system by having a sub-cooled liquid refrigerant flowing from the condenser for use in the evaporative cooling function of the refrigeration system.

A still further object of this invention is to provide an improved refrigeration system using a surge type receiver and that prevents uncondensed (flash) gas from entering the liquid line to the evaporators.

This invention comprises an energy efficient control for refrigeration systems that have air cooled condensers exposed to outdoor ambient conditions whereby an adequate high side pressure in cool weather is maintained by admitting discharge gas through a outlet pressure regulating (OPR) valve to the top of a surge receiver. The OPR valve opens on a drop of outlet pressure. This causes back-flooding of liquid in the condenser. The resultant sub-cooled liquid flows from the condenser to a tee connection with the bottom of the receiver and to the liquid supply line to the evaporator(s). Liquid can also flow from the bottom of the receiver as needed by the evaporators or can accumulate in the receiver if not needed.

In warm weather the OPR valve is closed and uncondensed gas can leave the condenser. A solid state liquid level sensing device or float switch at a flow-through reservoir at the outlet of the condenser detects a lowering of the liquid level in the reservoir and activates a solenoid valve that is piped in parallel with the OPR valve thereby pressurizing the receiver enough to cause back-flooding in the reservoir. When the liquid rises to the level of the liquid level sensor the solenoid is deactivated. Therefore uncondensed (flash) gas does not enter the liquid line. On some systems, the OPR valve is not needed as in warm climates, where heat reclaim is not used, where hot gas defrosting is not used or on low temperature systems where an elevated high side pressure is not necessary.

This invention is useful, as is my previous invention, as a retrofit for existing systems as well as in new installations, and can be incorporated into factory assembled condensing units. A requisite of one embodiment of this design is that the receiver is located at about the same elevation as the condenser. If this is a rooftop installation, there are several advantages in this placement. First there is greater static head pressure in the liquid line to the evaporators. At 90 degrees F. there is one pound per square inch more pressure for each 1.8 feet of vertical rise for Freon R-12. For R-502 the one psi increase occurs with each 1.84 feet vertical rise and for R-22 at each 1.98 feet vertical rise. Imposition of this amount of static head limits the formation of flash gas in the liquid line due to pressure drop caused by long lines, restrictions of fittings, and valves, and by liquid refrigerant lines passing through heated areas. Secondly, there is less heat gain than if the receiver is located in a machine room or other heated area and no space has to be allocated in the machine room for receivers. Sun shielding should be provided and all liquid lines in warm areas should be insulated. In cold climates, the receivers may require insulation and a thermostatic controlled heater. The temperature of the refrigerated space is a controlling factor to be considered as to whether a heated receiver is required.

BEST MODE OF CARRYING OUT THE INVENTION

Figure 1:
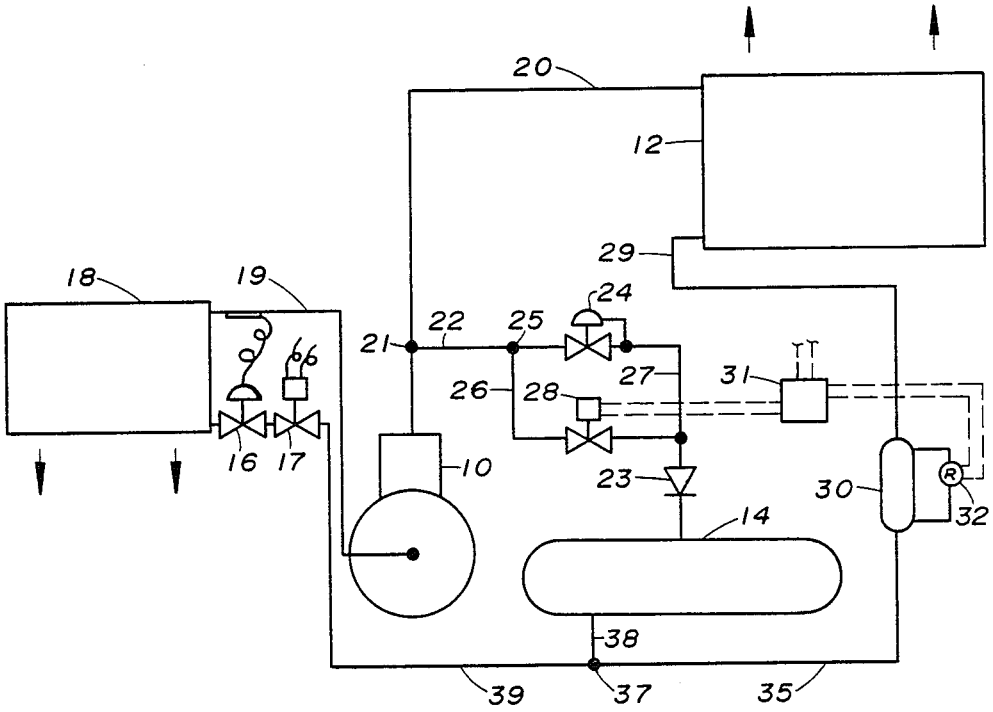
FIG. 1 is a diagram of a refrigeration system having the apparatus and method of this invention.

Referring to the drawings, wherein like numerals indicate like parts, there is seen in FIG. 1 a schematic diagram of a refrigerant system embodying this invention. A compression type refrigeration system is shown having an air cooled condenser 12 exposed to outside ambient conditions. Compressor 10, condenser 12, receiver 14, an expansion valve 16, and an evaporator 18 are shown connected in a closed refrigeration loop. High pressure gas from the compressor 10 enters the top of the condenser 12 and is liquefied in full or in part by heat transfer to the flow of ambient air through the condenser 12.

The condensed or mostly condensed refrigerant leaves the condenser 12 through line 29 and passes to a flow-thorough reservoir 30 that has a side arm connection 33 that has a liquid level fitting that includes a liquid level sensing thermistor 32. The refrigerant passes from the outlet of the reservoir through line 35 that includes a check valve 34 which prevents migration from the receiver 14 to the condenser and connects at a three way connection 37 to the outlet 38 from the bottom of receiver 14 which is at about the same elevation as the condenser and to the liquid line 39 that supplies liquid to the temperature controlled solenoid valve 17 if used and the thermostatic expansion valves 16 that feed refrigerant to the evaporator(s) 18.

In cool weather conditions an adequate high side (condensing) pressure is maintained by hot discharge gas that tees off of discharge line 20 at tee 21 and is directed through line 22 that includes check valve 23 which prevents migration from the receiver to the compressor and condenser to an adjustable outlet pressure regulating valve 24 which opens on a drop of outlet pressure and directs discharge gas through line 27 to the top of receiver 14. The OPR valve is typically set about 50 PSI above the evaporating pressure of the evaporator 18. The OPR would generally close in ambient temperatures above 50° F. In colder weather the OPR valve admits hot discharge gas to the top of the receiver 14. Due to the pressure drop through the condenser 12, liquid in the receiver is forced into the liquid line 39 and liquid is prevented or limited from leaving the condenser 12 and backfloods into the condenser thereby limiting the condensing surface and causing the high side pressure to rise to the setting of the OPR valve which throttles closed thereby permitting sub-cooled liquid to leave the condenser. An equilibrium is established and the OPR valve opens only enough to maintain the set condensing pressure. If there is a demand for more refrigerant by the evaporators, the level in the condenser will fall and be corrected by the OPR valve opening more, increasing the pressure in the receiver 14 and forcing liquid out of the receiver until the pressure reaches the set point of the OPR valve. Conversely, when there is a pump down of one evaporator, the OPR valve will close and excess refrigerant in the condenser will flow through the condenser drain line 29 and check valve 34 into the bottom of the receiver. The backflooded liquid in the condenser is sub-cooler and can approach within two degrees F. of the air entering condenser.

Under stabilized conditions, most of this sub-cooled liquid from the condenser goes directly to the liquid line 39 to the evaporators. This sub-cooling is important to increase the overall efficiency of the system and to lower power costs. A rule of thumb is that for each 10 degrees F. of sub-cooling the efficiency will increase 5 per cent.

In warm weather the OPR valve remains closed and there is very little sub-cooling in the condenser. Especially under full load from the evaporators or after a defrost of the evaporators, uncondensed (flash) gas can enter the condenser drain line 29 and cause the level of liquid in the reservoir 30 to fall below the level of the liquid sensing thermistor 32. The thermistor has a negative temperature coefficient resistance which changes with difference in thermal conductivity between a liquid and a vapor. The change in resistance causes a solid state circuit to activate a relay which energizes solenoid valve 28 which is piped in parallel with OPR valve 24 thereby pressurizing the receiver enough to cause backflooding in the condenser drain line 35 and the reservoir 30. When the level of the liquid rises to the level of the liquid level sensor (thermistor) 32, the solenoid is deactivated. Therefore uncondensed (flash) gas does not enter the liquid line. Flash gas in the liquid line in systems using surge receivers is and has been a severe problem and this system corrects that problem.

Figure 2:
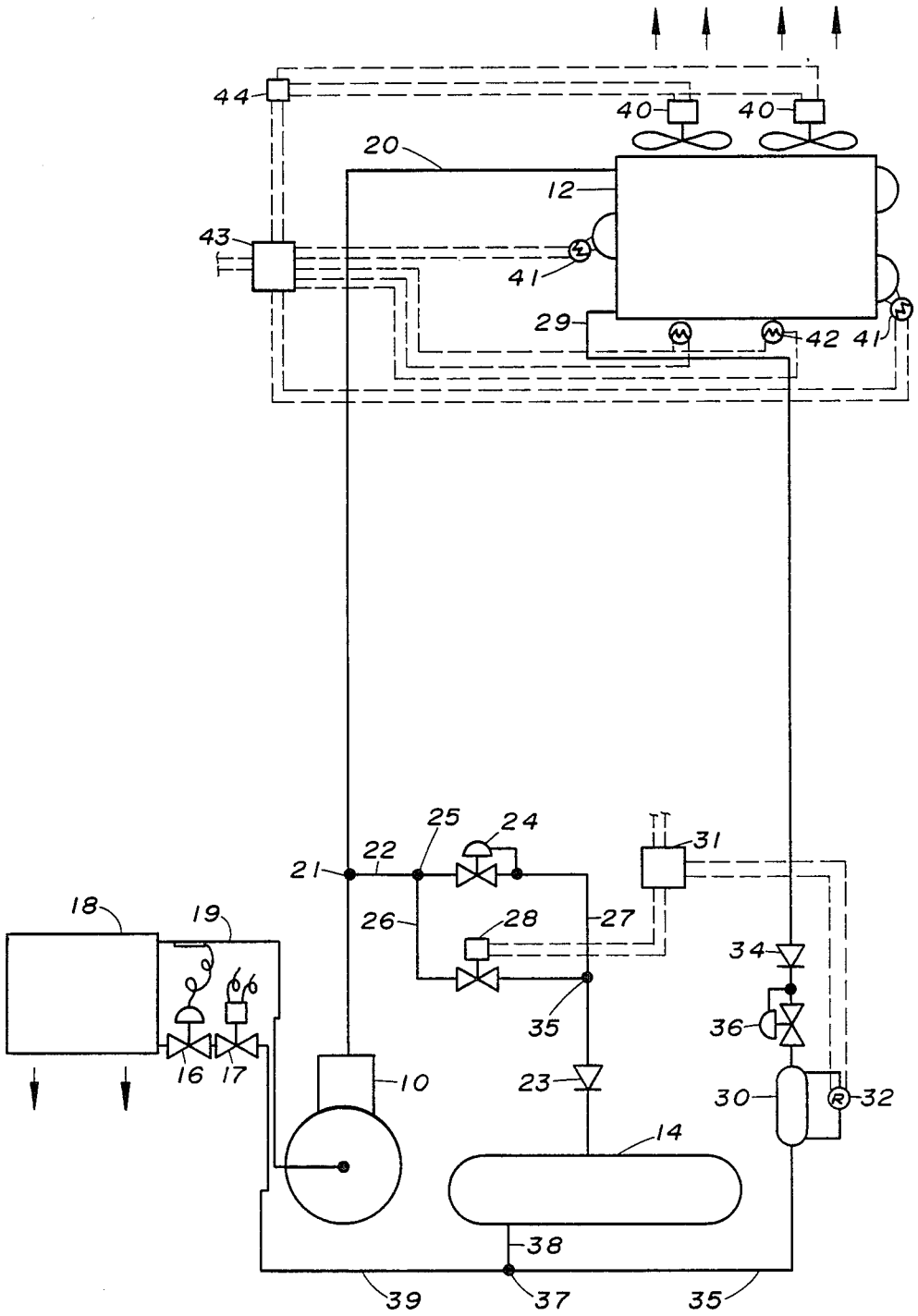
FIG. 2 is a diagram of a refrigeration system having a second embodiment of this invention wherein the receiver is located at a position substantially below the condenser and includes a third embodiment wherein the operation of the condenser fan motors is controlled by temperature sensing thermistors at the return bends of the condenser.

In a second embodiment of this invention as shown in FIG. 2, the receiver 14 is located at a position substantially below the condenser whereby the condenser outlet pressure plus the static pressure of the liquid in the condenser drain line can be more than the pressure at the inlet of the OPR valve 24 which would prevent the backflooding of liquid in the condenser. Therefore, an inlet pressure regulating (IPR) valve is located near the receiver. This valve opens on a rise of inlet pressure which effectively causes backflooding. The IPR valve is adjusted to maintain a minimum pressure of 3 to 5 PSI greater than the setting of the OPR valve. The flow through reservoir 30 located downstream from the IPR valve and the balance of the system operates the same as described for FIG. 1.

FIG. 2 also illustrates a third embodiment of this invention wherein the operation of the condenser fan motors 40 in cold weather is controlled according t the level of sub-cooled liquid in the condenser 12 by temperature sensing thermistors 41 and 42 through a solid state circuit 43 and relays 44. The level of flooding of liquid refrigerant in the condenser increases as the ambient temperature drops or the heat rejection load becomes lower therefore less air flow through the condenser 12 is needed to. assure that sub-cooled liquid, preferably within 2 to 5 degrees F. of the temperature of the entering air to the condenser, leaves the condenser. Typically for a rack assembly of three to four parallel compressors as in a supermarket installation, there can be three to four condenser fan motors each of 1½ h.p. Accordingly, where multiple condenser fan motors are used, the first fan is operated in parallel with the compressor or by a pressure switch. The remaining fans are controlled through a solid state circuit 43 and relays 44 preferably in steps. A primary thermistor 42 as a reference is placed in the air stream to the condenser. A second thermistor is secured to a return bend at the lower part of the condenser 12. The approach of the temperature of the second thermistor 41 to the temperature of the primary thermistor 42 actuates, through a solid state circuit, a relay to deactivate the electric circuit to the fan motor. A second and possibly third set of thermistors is similarly place progressively upward on the condenser to detect the sub-cooling at the return bends to control the operation of the remaining fans so as in cold weather to assure that sub-cooled liquid leaves the condenser with the minimum number of condensed fans in operation.

Figure 3:
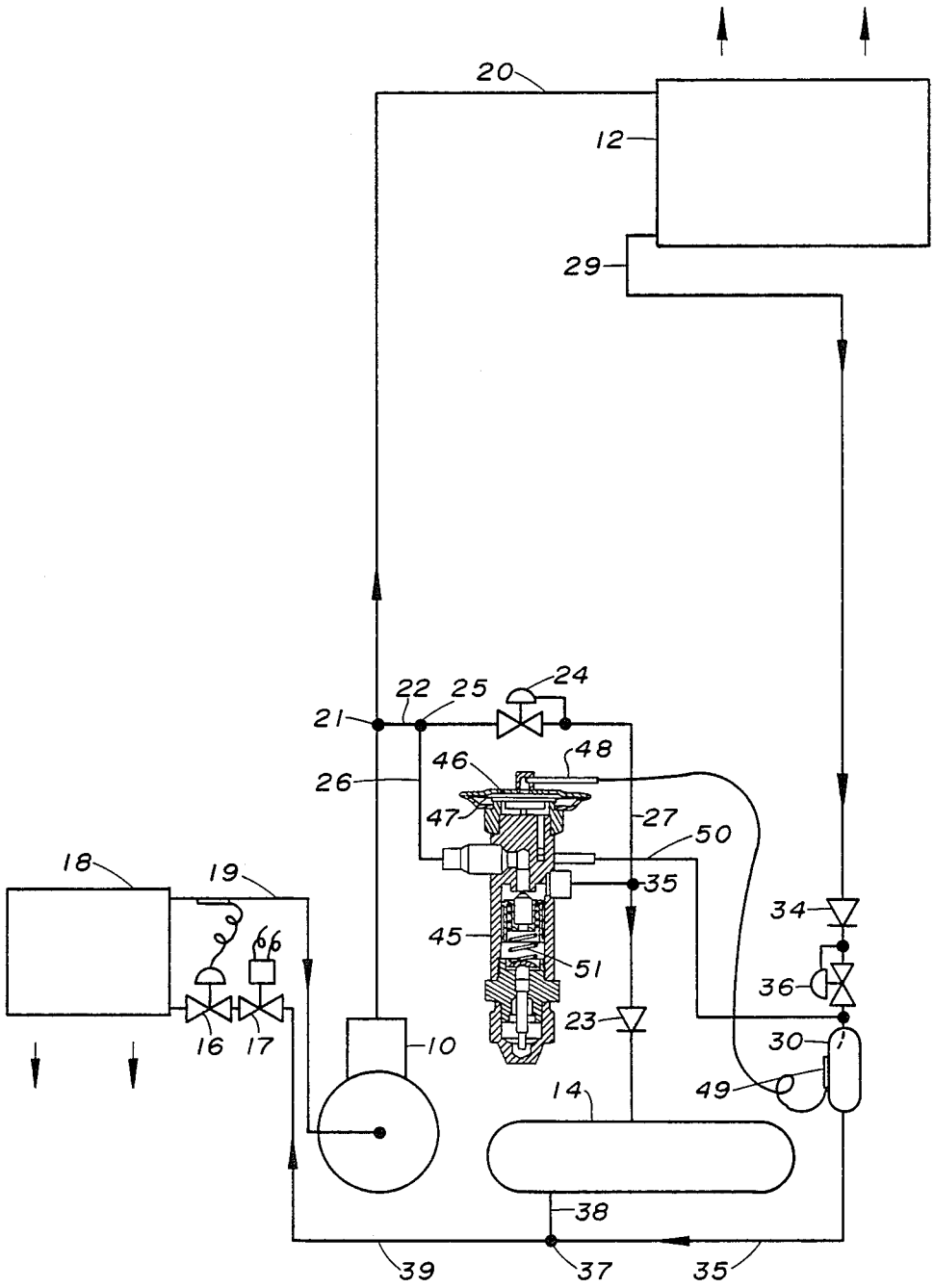
FIG. 3 is a fourth embodiment of this invention wherein a thermostatic control valve is used to sense a sub-cooled condition as an alternate to a solenoid valve controlled by a liquid level sensor or a float switch.

In the fourth embodiment of this invention as shown in FIG. 3 a thermostatic control valve 45 is used rather than the liquid level sensor 32 or float switch and solenoid valve 28. This thermostatic valve is piped in parallel with the OPR valve 24 and has the same function to pressurize the receiver enough to prevent uncondensed gas from entering the liquid line 39 in warm weather or when there is a high heat rejection load at the condenser 12. The valve has a power head 46 with a flexible diaphragm which responds to opposing forces on each side of the diaphragm to operate the opening and closing of the valve. The pressure on top of the diaphragm is conveyed through a capillary tube 48 from a bulb 49 strapped to the outlet line 29 of the condenser 12 or to the flow through reservoir 30. The bulb contains a mixed charge of gases that has a saturation pressure somewhat higher than the saturation pressure of the refrigerant in the system at the same temperature and maintains that same approximate ratio over the range of temperatures that is encountered. The pressure on top of the diaphragm is opposed by the pressure from the bottom of the diaphragm which is transmitted through tube 50 from the outlet of the condenser or the flow through reservoir 30 and by the force from a adjustable spring 51 so that a sub-cooled condition at the outlet o the condenser or flow through reservoir will shut off the flow of discharge gas to the top of the receiver. If mostly vapor is present at the outlet of the condenser and therefore there is no sub-cooling, the valve will open and cause backflooding of liquid into the flow through reservoir so that flash gas does not enter the liquid line.

Figure 4:
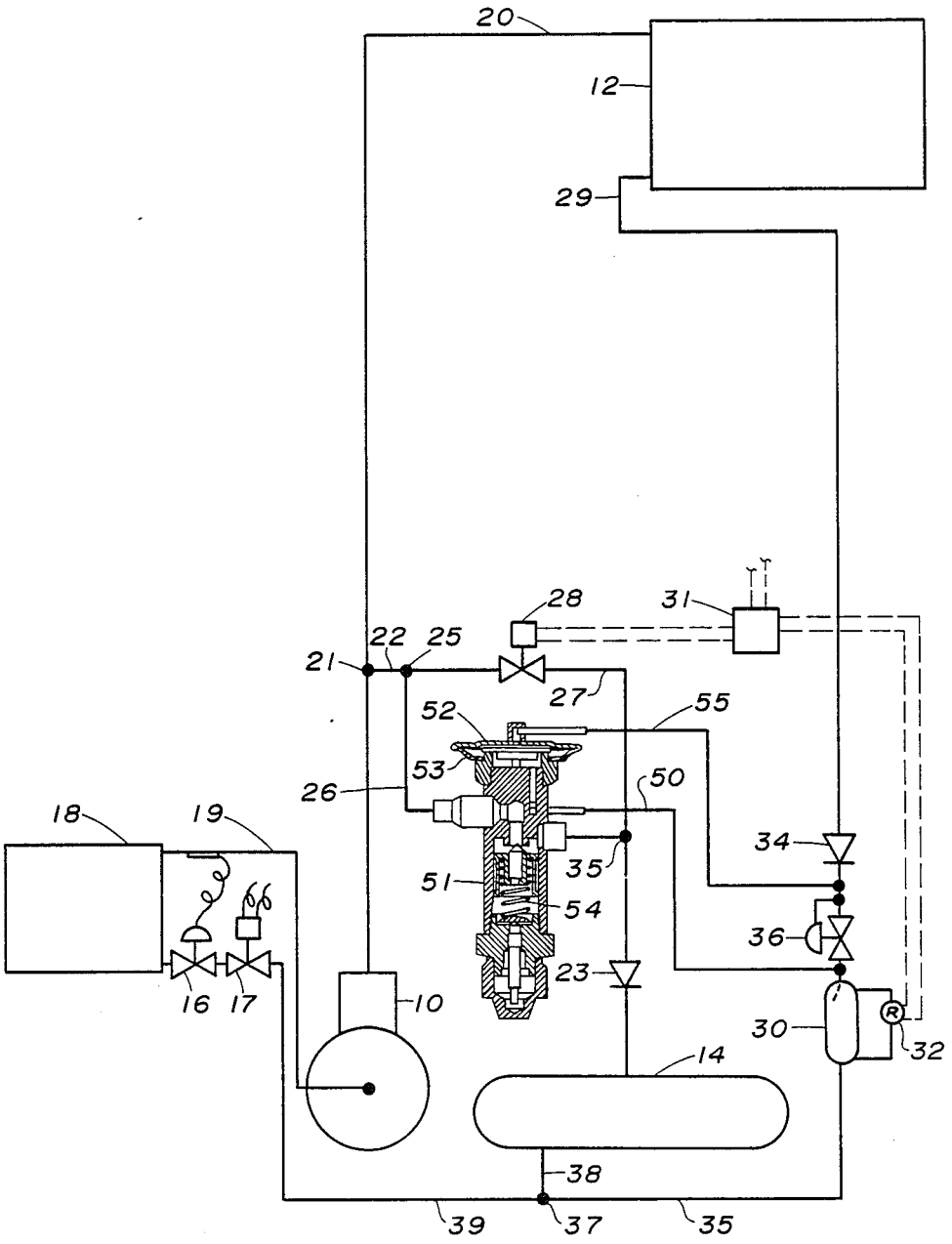
FIG. 4 is a fifth embodiment of this invention wherein a differential pressure regulating valve is used in conjunction with an inlet pressure regulating valve and replaces an outlet pressure regulation valve.

In a fifth embodiment of this invention as shown in FIG. 4, a differential pressure regulating (DPR) valve 51 is used in place of an OPR valve 24 in conjunction with an inlet pressure regulating (IPR) valve 36 where the condenser 12 is located substantially above the level of the receiver 14. This DPR valve 51 maintains a pressure difference, as adjusted of 2 to 5 PSI less than the pressure at the inlet of the IPR valve. This enables a subsequent adjustment of the IPR valve to be made without having to adjust the DPR valve. This valve as manufactured by Sporlan Valve Co. or Refrigeration Specialties Co. has a power head 52 with a flexible diaphragm 53 which responds to opposing forces to operate the valve. The pressure on top of the diaphragm is transmitted from a tube that connects upstream of the IPR valve and is opposed by the pressure on the bottom of the diaphragm that is transmitted by a tube from the outlet of the IPR valve plus the force from an adjustable spring 54. In warm whether conditions the IPR valve will be fully open and the DPR valve will be closed. The solenoid valve 28 and liquid level sensor 32 or the thermostatic control valve 45 that is piped in parallel to the DPR valve 51 will provide for pressurizing the top of the receiver 14 so that flash gas does not enter the liquid line 39.

I claim:

1. A refrigeration system having a closed refrigerant loop comprising:

a compressor;
a condenser;
a surge receiver;
expansion device;
an evaporator;

a discharge line connecting the compressor to the inlet of the condenser;

a receiver pressure control line connecting between the discharge line and the top of the receiver having pressure regulating means therein to establish a minimum receiver pressure in cold weather;

a condenser drain line connecting the outlet of the condenser to a three way connection with the bottom of the surge receiver and with a liquid line to the expansion device; and, a flow through reservoir means in said condenser drain line having a liquid level detection means therein to determine the liquid level in said flow through reservoir;

pressurization means in said receiver pressure control line opening to increase the pressure in said receiver whenever the liquid level in the flow through reservoir falls below a set limit.

2. The refrigeration system of claim 1 wherein a check valve is in said receiver pressure control line to prevent migration of refrigerant from the receiver to the condenser.

3. The refrigeration system of claim 1 wherein a check valve is in said condenser drain line to prevent migration of refrigerant from the receiver or said liquid line to the condenser.

4. The refrigeration system as defined in claim 1 wherein said condenser and said receiver are at approximately the same elevation and said pressure regulating means is an outlet pressure regulating valve in said receiver pressure control line and opens on a fall in outlet pressure below the adjustable setting of the valve to establish a minimum receiver pressure and, thereby cause backflooding of liquid in the condenser to decrease condensing surface, subcool the liquid refrigerant and maintain the minimum high side pressure in cold weather.

5. The refrigeration system of claim 4 wherein said receiver is at an elevation substantially below that of said condenser, and having an inlet pressure regulating valve in the condenser drain line located near the receiver, said inlet pressure regulating valve closing on a drop of inlet pressure and being adjusted for a pressure of approximately 2 to 5 PSI greater than the pressure setting of said outlet pressure regulate valve, said flow through reservoir being located just downstream from the inlet pressure regulating valve.

6. The refrigeration system as defined in claim 1 wherein said flow through reservoir is mounted vertically in said condenser drain line means to detect the liquid level in said flow through reservoir; said pressurization means comprising a solenoid valve connected in parallel with said pressure regulating means in said receiver pressure control line and said solenoid valve is activated whenever the liquid level in said flow through reservoir falls below a set limit, thereby causing liquid to backflood in said condenser drain line and said reservoir so that uncondensed gas does not enter said liquid line as in warm weather or high condensing load.

7. The refrigeration system of claim 6 wherein said means to detect the liquid level in said flow through reservoir comprises a liquid level sensing thermistor, said thermistor being in direct contact with the refrigerant and being sensitive to differences in conductivity between liquid and vapor refrigerant thus indicating when uncondensed gas is present in said flow through reservoir or said condenser drain line.

8. The refrigeration system of claim 6 wherein said means to detect the liquid level in said flow through reservoir comprises a float switch assembly that is connected by tubing to the top and bottom of said flow through reservoir.

* * * * *